United States Patent [19]

Hawes, Jr. et al.

[11] Patent Number: 5,066,045

[45] Date of Patent: Nov. 19, 1991

[54] HANGING LAMINATED FOLDER

[75] Inventors: Robert E. Hawes, Jr., Huntington Bay; Cheryl Dellacroce, Baldwin; Eric Aaldenberg, Bayside, all of N.Y.; James J. Lynch, Berkley Heights, N.J.

[73] Assignee: Esselte Pendaflex Corporation, Garden City, N.Y.

[21] Appl. No.: 483,094

[22] Filed: Feb. 21, 1990

[51] Int. Cl.[5] ..... A47B 63/00

[52] U.S. Cl. ..... 281/45; 40/359; 211/126

[58] Field of Search ..... 281/45, 46, 47, 48, 281/49, 50; 40/341, 359; 312/321; 211/126; 229/1.5 R

[56] References Cited

U.S. PATENT DOCUMENTS

| | | | |
|---|---|---|---|
| 2,291,724 | 8/1942 | Jonas | 312/321 |
| 3,779,393 | 12/1973 | Grundell | 40/359 |
| 3,933,294 | 1/1976 | Meenan et al. | 40/359 |
| 4,031,646 | 6/1977 | de Nouël | 40/359 |
| 4,053,057 | 11/1977 | Snowden | 40/359 |
| 4,284,227 | 8/1981 | Corey | 229/1.5R |
| 4,749,121 | 6/1988 | Barber et al. | 40/359 |
| 4,830,268 | 5/1989 | Pitts | 40/359 |

OTHER PUBLICATIONS

The blue folder having top and bottom laminations for U.S. patent application No. 07/128,337, Dec. 1987, U.S. PTO.

*Primary Examiner*—Frank T. Yost
*Assistant Examiner*—Hwei-Siu Payer
*Attorney, Agent, or Firm*—Darby & Darby

[57] ABSTRACT

A hanging folder has reinforcing strips along its top and bottom edges, and color contrasted easy-insert label slots. These strips and contrasting slots protect against wear to the folder and thus prolong the usefulness of the folder.

10 Claims, 1 Drawing Sheet

HANGING LAMINATED FOLDER

TECHNICAL FIELD

The present invention relates to paper office supplies and, in particular, to hanging folders having laminated portions for increased strength, longer life and paper surface integrity.

BACKGROUND ART

Paper hanging folders, for use in standard storage units such as file cabinets, desk drawers and the like, are a necessary tool in modern offices and businesses. Such folders in the art are best exemplified by expired U.S. Pat. No. 2,291,724, which was assigned to the assignee of the present application. This reference describes a file formed by a sheet of heavy material with a central horizontal fold which forms the folder's bottom and open sides. Folds are provided in the file's top edges through which hanging rods are movably or immovably fixed. The ends of these rods are exposed and notched, enabling the file to hang on a complementary standard parallel file frame in office storage equipment, such as filing cabinets and desk drawers.

The inner surfaces at the tops of the folded-over portions contain uniformly spaced slots for insertion of labeling tabs. These slots often tear or wear out as new tabs are inserted or removed, due to the need for frequent file relabeling or repositioning of labels in alternative slots of the file. Also, when the user inserts the tabs of the label into the slots, close attention is required because the opening of the slot and the material behind it are generally identical in color. Due to the wear and tear on tab slots, files are often replaced simply because the tab slots are torn or worn out, rendering the file useless. Also, handling during normal use and tab changing causes additional wear on the top of the file due to the release of body oils and friction between the paper and fingers. This type of wear is not diminished by the rods disposed through the file's top folds, because finger oils and friction break down the material of the file, which is generally paper, regardless of the underlying support of the rod.

U.S. Pat. No. 4,749,121 discloses a hanging folder with a reinforcing plastic film applied to the side edges to reduce wear on the side of the file as it is moved in the frame. This film may be applied with colored adhesive to provide a color coding system or a clear film may be applied over a colored surface by a clear adhesive to achieve the same result. Similar side reinforcing techniques are disclosed in U.S. Pat. Nos. 4,523,776 and 4,580,815.

When hanging files are filled with a large volume of paper, the sides tend to spread away from each other and the bottom lifts. However, the present inventor has learned that when the file holds a narrow heavy object, the bottom of the file drags along the bottom of the drawer or other container for the frame, leading to wear and tear on the bottom of the file. This necessitates file replacement before the body of the file has worn out.

It is clear that a need exists for a hanging folder file which has a strong bottom to hold the weight of its contents and to guard against wear due to its being dragged along the bottom of a drawer. Also, a reinforced top edge is needed to guard against wear from handling and the insertion of tabs. A need further exists for a folder which makes tab insertion easy and faster than folders of the prior art now allow.

SUMMARY OF THE PRESENT INVENTION

The present invention is directed to hanging folders formed by folding a sheet of heavy duty paper along one or more medial lines which form the folder's bottom. The outside of the lower surface of the bottom of the folder has a laminated strip across its entire length. The top edges of the paper are folded over and glued down to the inside of the file and provide openings for hanging rods from which the folder is suspended on a standard file frame in office storage equipment. The inner surfaces of the top folds have slots for insertion of labelling tabs. If the outside and inside surface of the sheet are of different colors, the inside of the front and rear faces below the folded down portion will be of a contrasting color to the rest of the file. This color contrast is visible through the tab slots.

If desired, a reinforcing strip may be laminated over the upper part of the front and rear surfaces of the file. This strip may extend over the top of the front and rear surfaces and down to the lower edge of the folded over portion.

Folders formed according to the present invention give at least three advantages to the user. First, the bottom of the folder is laminated to prevent tearing and wear from the weight of the file's contents, and scraping of the file along the bottom of a drawer. Second, the color contrast between the area surrounding the tab slots and the area behind the slots enables quick and easy visual location of the slots for easy insertion of tabs, thus leading to less effort on the part of the user and less wear and tear on the tabs and slots. Third, the outer and inner top edges of the file, except the tab slots, are also covered with a laminate to decrease wear and tear from normal handling and tab insertion. All of these advantages add to the durability of the file's top and bottom, prolonging its usefulness.

BRIEF DESCRIPTION OF THE DRAWINGS

The foregoing and other features of the present invention will be more readily apparent from the following detailed description and drawings of an illustrative embodiment of the invention in which.

DESCRIPTION OF THE PREFERRED EMBODIMENTS

Figure 1:
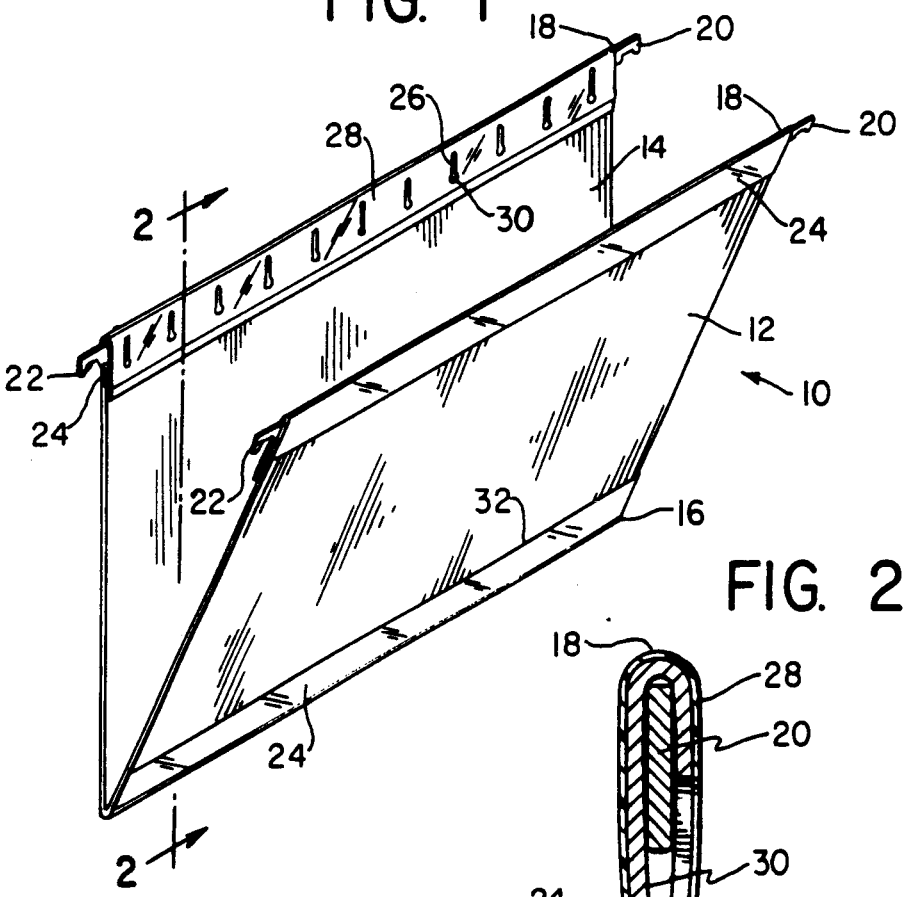
FIG. 1 shows a perspective view of a hanging folder of the present invention having reinforcing top and bottom laminated strips and color contrasted label slots.
Figure 2:
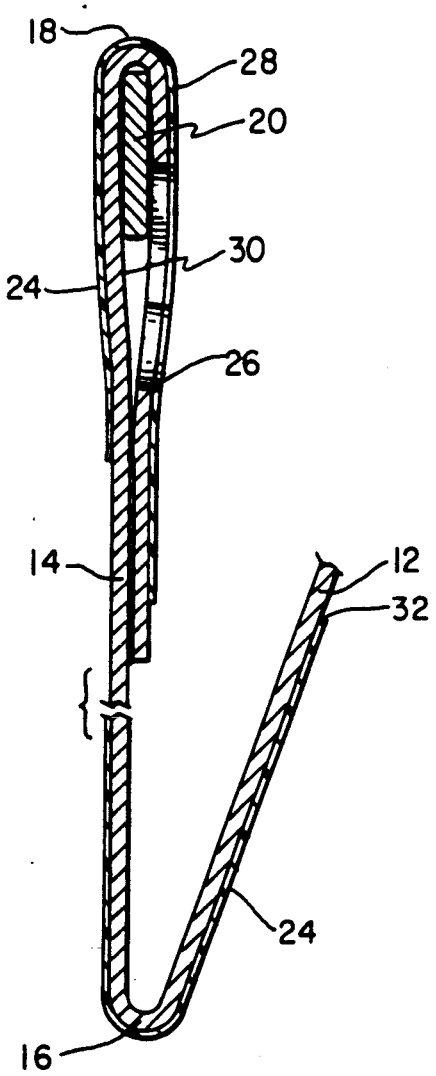
FIG. 2 shows a right side sectional view (partially broken) of the hanging folder of FIG. 1 along line 2—2.

FIG. 1 shows a hanging folder 10 having a front portion 12, and a rear portion 14 connected along one or more medial folds 16. At the upper edges of the front and rear portions there are terminal folds 18 which, on the inside of the file, define slots for tabs and through which hanging rods 20 are disposed, as shown in FIG. 2. The end portions of each hanging rod 20 have notches 22 which are complementary to a standard filing frame in office storage equipment, enabling the file to hang while stored, e.g. in a file drawer. The outer surface of the folder in the area of the medial fold 16 and the terminal folds 18 are covered by a reinforcing strip 24 which is preferably laminated thereto. These strips prolong the life of the file.

This lamination 24, the placement of which is shown in detail in FIG. 2, protects against frequent handling at the terminal edges of the file, strengthens the file's bottom, and protects the bottom of the file when it is dragged along a file drawer bottom while carrying the weight of narrow stored papers and other items.

The only portions of the file's terminal fold not covered by lamination are the shaped slots 26, through which labels, visible as the file hangs in a standard storage unit, are inserted.

In a preferred embodiment, the color of the inner surfaces of the material from which the file is made differ from the color of the outer surfaces. As a result, the slotted portion of the laminated edge 28 contrasts with the color of the inside portion of the file 30 and is visible through the slots 26. This color contrast makes visual location of the slot and insertion of new tabs into the slot easier. Easier insertion results in less contact with the portion surrounding the slots 26, reduction in wear and prolonged usefulness life of the file 10. The lamination also makes it easier to punch the teardrop slots during manufacture of the folder.

Some embodiments may have a multiplicity of horizontal depressions 32 on the bottom edges of the file, which can be folded by the user to create additional medial folds to expand, i.e. square off, the file's bottom.

While the present invention has been particularly shown and described with reference to a preferred embodiment thereof, it will be understood by those skilled in the art that various changes in form and details may be made therein without departing from the spirit and scope of the invention.

I claim:

1. A hanging folder comprising:

a sheet of flexible material folded at a medial line to form a bottom edge with a lower surface, and front and rear portions joined at the bottom edge, the edges of the front and rear portions remote from the bottom edge being folded over to form top terminal folded portions;

rods complementary to a standard filing frame being disposed through said top terminal folded portions; and first reinforcing means in the form of a strip of plastic material disposed along a major portion of, and covering, said top terminal folded portions; and second reinforcing means in the form of a strip of plastic material disposed along a major portion of said bottom edge of the folder for increasing the wear resistance, strength and life of the lower surface of the bottom edge, said strip covering the medial line and lower areas of said front and rear portions.

2. A hanging folder as claimed in claim 1 further including uniformly spaced slots in at least an inner surface of the top terminal folded portions and wherein said first reinforcing means surrounds, but do not cover said slots.

3. A hanging folder comprising:

a sheet of flexible material folded at a medial line to form a bottom edge with an exterior surface, and front and rear portions joined at the bottom edge, the ends of the front and rear portions remote from the bottom edge being folded over to form top terminal folded portions;

reinforcing means in the form of a first strip of plastic material disposed along a major portion of said bottom edge of the folder for increasing the wear resistance, strength and life of the bottom edge, said strip covering the medial line and lower areas of said front and rear portions, and a second strip of plastic material disposed along a major portion of at least one of said top terminal folded portions; and means for hanging the folder on a standard filing frame in office storage equipment.

4. A hanging folder as claimed in claim 3 wherein said hanging means comprises two rods having notches complementary to a standard filing frame, said rods being disposed through said terminal folded portions on the top edges of said front and rear portions.

5. A hanging folder as claimed in claim 3 wherein the folder is made of one of colored paper, plastic and fiber, and said rods are made of metal.

6. A hanging folder as claimed in claim 3 wherein the bottom edge of the folder has at least one horizontal linear depression which provides a crease line for forming at least one additional medial line to allow for expansion of the bottom of the folder.

7. A hanging folder as claimed in claim 1, wherein said first strip of plastic material is on the exterior surface of the bottom edge of said hanging folder.

8. A hanging folder comprising:

a sheet of flexible material folded at a medial line to form a bottom edge with an exterior surface, and front and rear portions joined at the bottom edge, the ends of the front and rear portions remote from the bottom edge being folded over to form top terminal folded portions;

reinforcing means in the form of a first strip of plastic material disposed along a major portion of said bottom edge of the folder for increasing the wear resistance, strength and life of the bottom edge, said strip covering the medial line and lower areas of said front and rear portions;

hanging means for hanging the folder on a standard filing frame in office storage equipment, said hanging means including two rods having notches complementary to the standard filing frame, said rods being disposed through the terminal folded portions on the top edges of said front and rear portions;

uniformly spaced slots in at least one of said terminal folded portions for receiving label tabs, said slots being transverse to said medial line, the length of said slots being larger than the height of said rods, and wherein an exterior surface of at least one of the front and rear portions of said folder has a color different than an interior surface of said folder such that the interior surface visible through the slots contrasts in color with the exterior surface of the at least one of the front and rear portions which is folded over and in which the slots are formed.

9. A hanging folder as claimed in claim 4, wherein said reinforcing means includes a second strip of plastic material which covers at least one of said terminal folded portions, excluding the slots, and the top areas and edges of the corresponding one of said front and rear portions.

10. A hanging folder as claimed in claim 9, wherein said first strip of plastic material is on the exterior surface of the bottom edge of said hanging folder.

* * * * *